US006092663A

United States Patent [19]

Dixon

[11] Patent Number: 6,092,663

[45] **Date of Patent: *Jul. 25, 2000**

[54] BOOK-TYPE CARTON WITH PULL OUT TRAY

[75] Inventor: Rodney Dixon, Burlington, N.C.

[73] Assignee: Mebane Packaging Group, Mebane, N.C.

[ * ] Notice: This patent is subject to a terminal disclaimer.

[21] Appl. No.: 09/132,636

[22] Filed: Aug. 11, 1998

Related U.S. Application Data

[63] Continuation of application No. 08/683,660, Jul. 17, 1996, Pat. No. 5,791,487.

[51] Int. Cl.[7] ..... B65D 25/02

[52] U.S. Cl. ..... 206/758; 206/769; 206/472

[58] Field of Search ..... 206/730, 731, 206/732, 735, 758, 745, 736, 769, 772, 773, 774, 472, 784, 91, 90, 566

[56] References Cited

U.S. PATENT DOCUMENTS

| | | | |
|---|---|---|---|
| 639,746 | 12/1899 | MacDonald . | |
| 1,252,944 | 1/1918 | Postolowski | 206/90 |
| 1,870,907 | 4/1932 | Groomes et al. . | |
| 3,351,182 | 11/1967 | Greer et al. . | |
| 3,404,829 | 10/1968 | Stone | 229/44 |
| 3,684,084 | 8/1972 | Kanzelberger | 206/45.31 |
| 3,888,264 | 6/1975 | Baclit | 206/246 |
| 3,915,295 | 10/1975 | Morrison | 206/91 |
| 3,987,955 | 10/1976 | Saarinen | 229/20 |
| 4,070,489 | 1/1978 | Pahnke | 426/115 |
| 4,514,961 | 5/1985 | Gillie | 53/449 |
| 4,949,845 | 8/1990 | Dixon | 206/626 |
| 5,433,316 | 7/1995 | McQueeny | 206/232 |
| 5,511,722 | 4/1996 | Dixon | 229/225 |
| 5,518,172 | 5/1996 | Nanno | 229/125.05 |
| 5,791,487 | 8/1998 | Dixon | 206/758 |

FOREIGN PATENT DOCUMENTS 1036133 of 1966 United Kingdom .

*Primary Examiner*—Jacob K. Ackun
*Attorney, Agent, or Firm*—Rhodes, Coats & Bennett L.L.P.

[57] ABSTRACT

A book-type carton for holding and displaying an article, the carton including a base carton and a tray. A cover flap selectively positionable between an open position and a closed position is hingedly connected to the base carton. The tray is slidably mounted in the base carton and is selectively positionable between an extended position and a retracted position. One of the tray and the cover flap has a closure tab forming a part thereof. The other of the tray and the cover flap has a slot forming a part thereof. The closure tab and the slot are relatively arranged and configured such that, when the tray is in the retracted position and the cover flap is in the closed position, the slot and the closure tab engage to releasably lock the cover flap in the closed position. A partition may be provided in the base carton to align the tray. A stop tab and limiter tab may extend from the tray to resist removal and overinsertion of the tray with respect to the base carton.

8 Claims, 7 Drawing Sheets

BOOK-TYPE CARTON WITH PULL OUT TRAY

This is a continuation application claiming the benefit of application Ser. No. 08/683,660 filed Jul. 17, 1996, entitled BOOK TYPE CARTON WITH PULL OUT TRAY in the name of Rodney D. Dixon, now U.S. Pat. No. 5,791,487, the disclosure of which is incorporated herein by reference.

FIELD OF THE INVENTION

The present invention relates generally to folding cartons and, more particularly, to a book-type folding carton having a pull out tray.

BACKGROUND OF THE INVENTION

Marketers of consumer products are continually looking for improved and versatile means for packaging various goods. Certain characteristics, including those as discussed below, are particularly desirable.

The packaging should be visually and tactilely appealing to the consumer. This involves providing a clean and unitary appearance as well as a relatively sturdy construction. These characteristics give the impression that the package is of good quality and, therefore, that the packaged product is of good quality as well.

For many products today, it is necessary or desirable to provide related literature. For example, in the case of pharmaceutical products, certain regulatory information such as warnings, directions, lot number, and expiration date may be required to be presented with the product. In other cases, the marketer may simply want to provide promotional literature to induce purchase. Thus, it is desirable that packaging include means for displaying the information in a manner which does not detract from the overall appearance of the packaging. Further, it is often desirable to display the information in a manner which allows the information to be inspected without destroying the packaging in case the customer does not purchase the unit.

For many products, it is desirable that the packaging allow clear display of the product without breach of the packaging. That is, the product may be viewed without opening the package in a manner which would give subsequent potential purchasers the impression that the product or packaging has been improperly tampered with.

It is highly desirable that a given package of prescribed size and shape, as far as its outer configuration is concerned, be adaptable to house products therein of different shapes and sizes. Preferably, such adaptation of the package does not alter its exterior dimensions. In this way, the package may be handled, bulk packaged and displayed in a given standard manner or configuration without regard to the particular size or shape of the article.

Thus, there exists a need for a container which is visually and tactilely appealing to potential customers. Such packaging should give the impression that the packaging, and thus the packaged product, is of good quality and is sturdy. There exists a need for packaging which allows for the display of related literature. There exists a need for such packaging which further allows inspection of the related literature without destruction to the package. In general, there exists a need for a container which is versatile and may be used to package a variety of products. The packaging as described above should be cost effective to manufacture, assemble, and fill with product.

SUMMARY OF THE INVENTION

The present invention is directed to a unique and versatile book-type carton for holding and displaying an article. The carton includes a base carton. A cover flap is hingedly connected to the base carton and has at least one free edge not secured to the base carton. The cover flap is selectively positionable between a closed position wherein the free edge is disposed adjacent the base carton, and an open position wherein the free edge is spaced apart from the base carton. A tray is slidably mounted in the base carton and selectively positionable between an extended position and a retracted position. One of the tray and the cover flap has a closure tab forming a part thereof. The other of the tray and the cover flap has a slot forming a part thereof. The closure tab and the slot are relatively arranged and configured such that, when the tray is in the retracted position and the cover flap is in the closed position, the slot and the closure tab engage to releasably lock the cover flap in the closed position.

The carton as described above may include a top panel forming a part of the base carton. An opening formed in the top panel overlies at least a portion of the tray when the tray is in the retracted position. The cover flap may include a subflap extending from an edge thereof, the slot formed in the subflap.

In a preferred embodiment, the carton includes a limiter tab extending sidewardly from a front end of the tray. The base carton includes a front wall having an opening formed therein. The tray is slidable through the opening. The tray, the limiter tab, and the opening are relatively arranged and configured such that the limiter tab resists overinsertion of the tray into the base carton by abutting a portion of the front wall adjacent the opening when a prescribed amount of the tray is inserted into the base carton.

A stop tab may be provided extending from the tray. The stop tab is operative to resist removal of the tray from the base carton. In a preferred embodiment, the base carton includes a front wall having an opening formed therein. The tray is slidable through the opening. The opening, the tray, and the stop tab are relatively arranged and configured such that the stop tab resists removal of the tray from the base carton by abutting a portion of the front wall adjacent the opening when the tray is in a fully extended position with respect to the base carton.

The present invention is further directed to a carton for holding an article as follows. A base carton is provided having opposed top and bottom spaced apart panels. At least one of the top and bottom panels has opposed first and second spaced apart side edges. A tray is slidably mounted between the top and bottom panels and between the side edges. The tray is spaced apart from at least the first side edge. A partition is disposed between the top and bottom panels and between the tray and the first side edge. The partition is arranged and configured to maintain the tray in a prescribed alignment with respect to the base carton and to maintain the tray in spaced relation with the first side edge.

The carton as just described including a partition may also include a second partition opposite and spaced from the first partition. The second partition is disposed between the top and bottom panels and between the tray and the second side edge. The second partition is arranged and configured to maintain the tray in the prescribed alignment with respect to the base carton and to maintain the tray in spaced relation with the second side edge.

In the carton having a partition as described above, a stop tab may be provided extending from the tray. The stop tab is operative to resist removal of the tray from the base carton. Further, in one embodiment the base carton includes a front wall having an opening formed therein. The tray is slidable through the opening. The opening, the tray, and the stop tab are relatively arranged and configured such that the stop tab resists removal of the tray from the base carton by abutting a portion of the front wall adjacent the opening when the tray is in a fully extended position with respect to the base carton.

In an alternative embodiment of a carton as described above having a partition and a stop tab, the tray, the stop tab, and the partition are relatively arranged and configured such that the stop tab resists removal of the tray from the base carton by abutting a portion of the partition when the tray is in a fully extended position with respect to the base carton. Preferably, the base carton includes a front wall having an opening formed therein, the tray slidable through the opening. The portion of the partition is spaced rearwardly from the front wall. The portion of the partition includes a partition tab biased inwardly from the partition in the path of the stop tab.

The carton having a partition may further include a limiter tab extending sidewardly from a front end of the tray. The base carton includes a front wall having an opening formed therein, the tray slidable through the opening. The tray, the limiter tab, and the opening are relatively arranged and configured such that the limiter tab resists overinsertion of the tray into the base carton by abutting a portion of the front wall adjacent the opening when a prescribed amount of the tray is inserted into the base carton.

The present invention is further directed to a tray for use with a base carton, the tray arranged and configured to be slidably mounted in the base carton. The tray includes at least one stop tab extending outwardly therefrom and adapted to abut against a portion of the base carton when the tray is extended to a prescribed position with respect to the base carton, thereby resisting removal of the tray from the base carton.

The present invention is further directed to a book type carton having a cover flap and a tray as first described, and further including a partition as described above. Moreover, such a book-type carton may include various combinations of the features and aspects as discussed above with regard to those embodiments.

An object of the present invention is to provide a container which is visually and tactilely appealing to potential customers.

An object of the present invention is to provide a container which gives the impression that the packaging, and thus the packaged product, is of good quality and is sturdy.

A further object of the present invention is to provide packaging which allows for the display of literature relating to articles held in the package.

Another object of the present invention is to provide such packaging which further allows inspection of the related literature without destruction of the package.

Moreover, an object of the present invention is to provide a container which is versatile and which may be used to package a variety of products.

Yet another object of the present invention is to provide packaging as described above which is cost effective to manufacture, assemble, and fill with product.

The preceding and further objects of the present invention will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENTS

Figure 1:
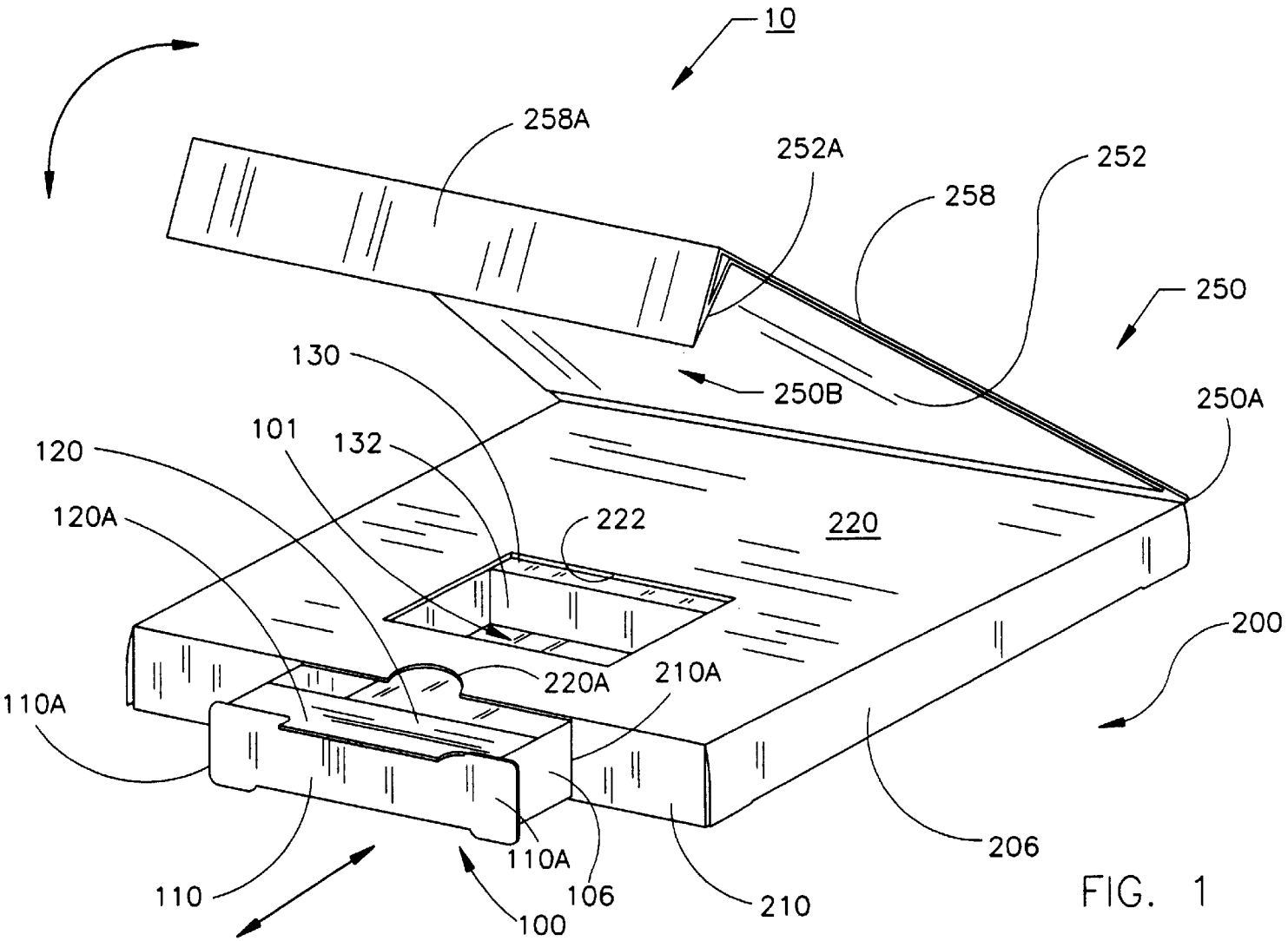
FIG. 1 is a perspective view of a container according to the present invention with a cover flap forming a part thereof partially opened and a tray forming a part thereof partially extended.

With reference to the figures, and in particular FIG. 1, a carton 10 according to the present invention is shown therein. Carton 10 includes, generally, base carton 200, tray 100, and cover flap 250. Tray 100 is slidably mounted in base carton 200 and may be transitioned between a retracted position (FIG. 6) and an extended position (FIG. 8) through aperture 210A formed in front end wall 210. Cover flap 250 as shown is integrally formed with base carton 200 and is foldable about fold 250A. However, it will be appreciated from the following that cover flap 250 may be separately formed from base carton 200 and secured by suitable means for pivotal movement about fold 250A.

Figure 6:
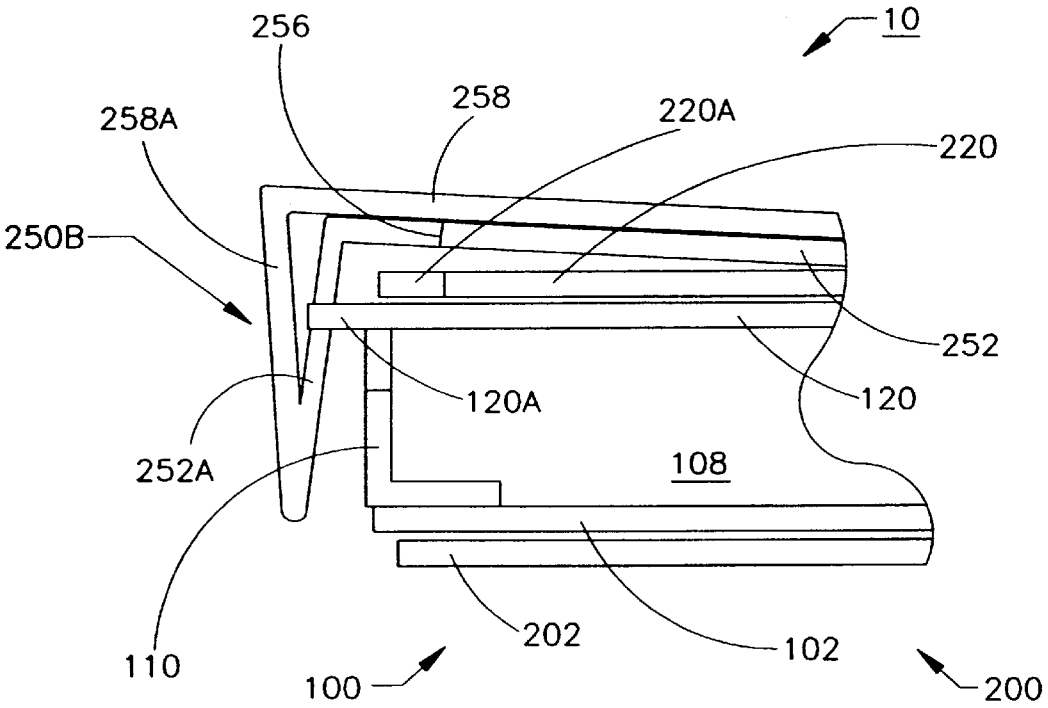
FIG. 6 is a fragmentary cross sectional view of the carton as viewed along the center of the container, the tray being in a fully inserted position and the cover flap being in a closed and locked position.

Tray 100 has formed as a part thereof tab 120A. Cover flap 250 has formed as a part thereof subflap 250B having slot 256 (see FIGS. 6 and 7) therein. When tray 100 is in the retracted position as shown in FIG. 6 and cover flap 250 is in the closed position, also as shown in FIG. 6, slot 256 and tab 120A interlock to prevent lifting of cover flap 250 away from base carton 200. When desired, cover flap 250 may be raised by exerting sufficient force to overcome the interlock of tab 120A and slot 256. While a preferred embodiment is discussed herein, it will be appreciated that subflap 250B and tray 100 need not be disposed on the side opposite fold 250A. Rather, subflap 250B and tray 100 may be positioned on one of the other side edges and panels, it only being necessary that they be positioned on the same side. While the carton 10 according to the present invention has been described in general above, it is provided with certain additional features and attendant advantages, and may be modified, as discussed below.

Figure 2:
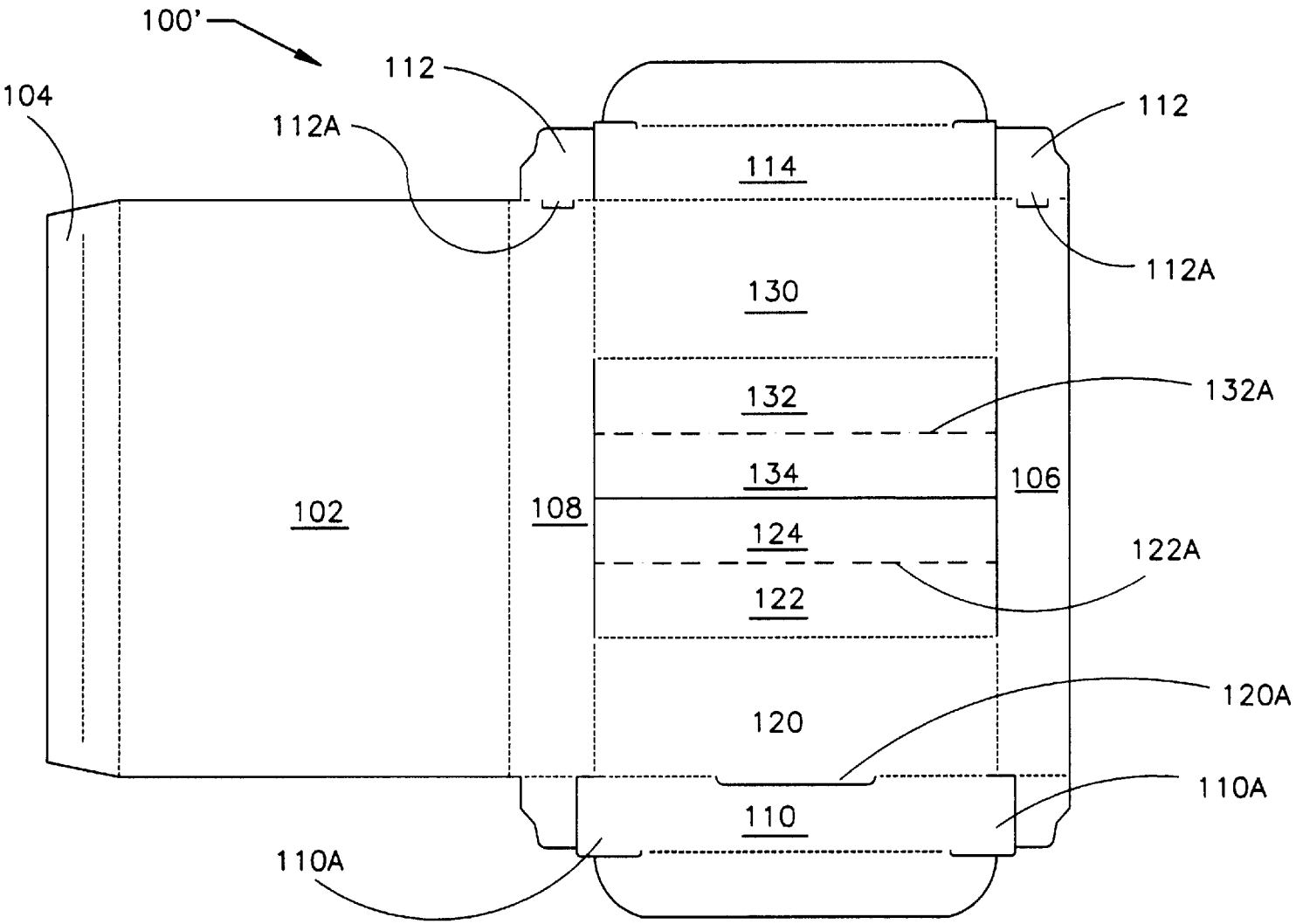
FIG. 2 is a plan view of a blank foldable sheet material from which the tray constructed according to the present invention may be formed.

Turning to FIG. 2, there is shown therein a blank 100' which may be folded and appropriately glued to construct tray 100. Blank 100' is preferably formed from paper board. The method of constructing tray 100 from blank 100' will be appreciated by those of ordinary skill in the art from an inspection of FIGS. 2 and 3 as well as the following description.

Bottom panel 102 is folded beneath the remainder of blank 100' such that bottom panel 102 is spaced apart and below top panels 120, 130. Side panels 104 and 106 overlap, preferably with side panel 106 being outwardly facing. Side panels 104 and 106 are secured by their adjoining faces using a suitable adhesive, for example, a cold glue or hot melt glue. Front end wall 110 and rear end panel 114 are each folded down. Prior to folding rear end wall 114 down, flaps 112 are folded inwardly in conventional fashion. Panels 122 and 132 are folded downwardly from top panels 120 and 130, respectively, as panels 124 and 134 are folded upwardly about perforation lines 122A and 132A, respectively. Upwardly opening compartment 101 is thereby formed in tray 100.

Notably, as front end wall 110 is folded down, end tab 120A remains with top panel 120 and extends forwardly of front end wall 110. Also, tabs 100A forming a part of front end wall 110 extend sidewardly beyond side panels 108 and 106. As flaps 112 are folded inwardly, rear side tabs 112A separate from side panels 106, 108 and extend sidewardly beyond the side panels. The functionality and operability of the above noted features will be discussed hereinbelow with relation to base carton 200 and cover flap 250.

Figure 4:
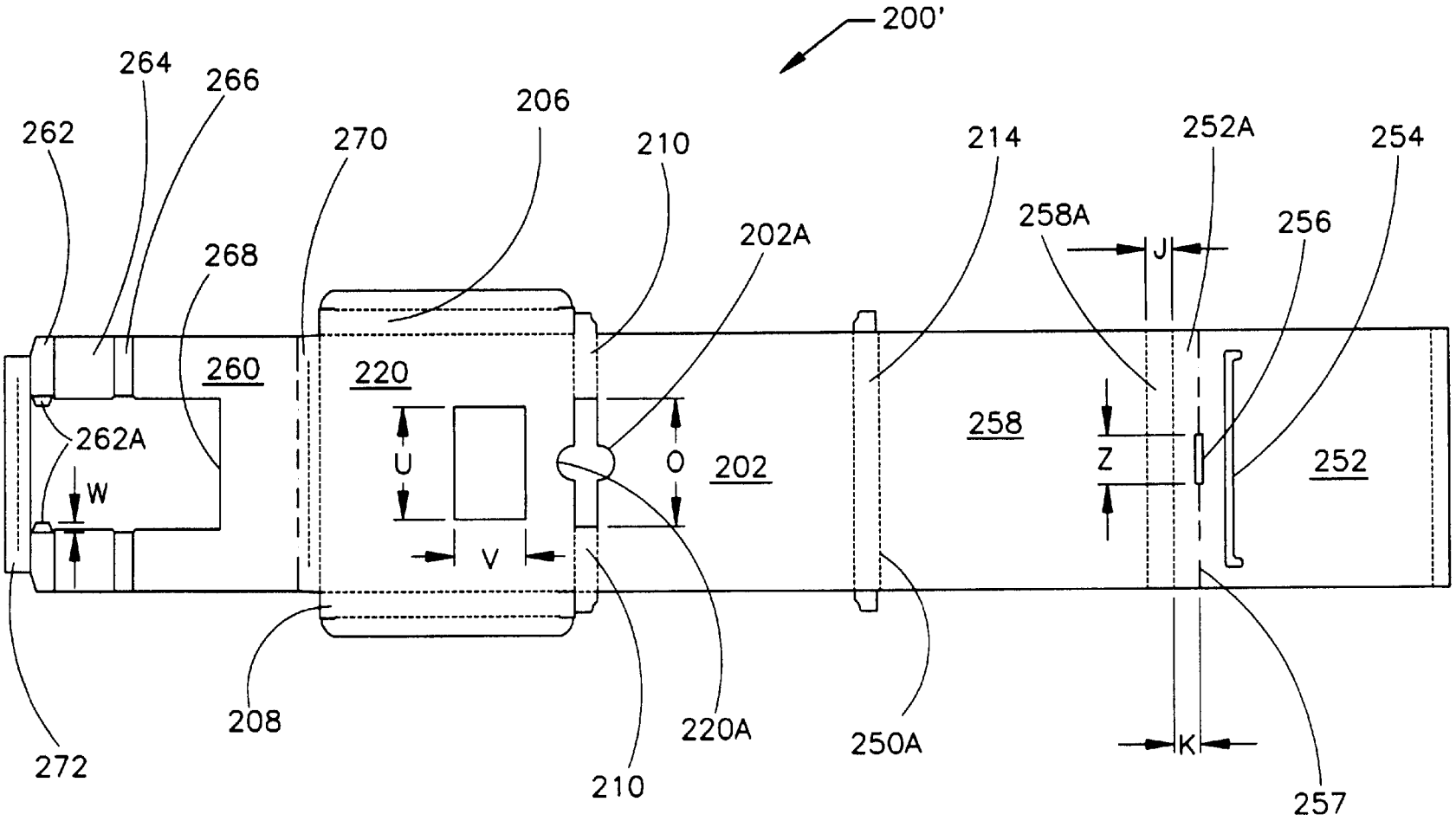
FIG. 4 is a plan view of a blank foldable sheet material from which a base carton constructed according to the present invention may be formed.

The construction of base carton 200 and cover flap 250 will be discussed with reference to FIGS. 1, 4, 5, 7, and 8. In particular, FIG. 4 shows a blank 200' for forming base carton 200 and cover flap 250. Blank 200' is preferably formed from the same materials as discussed above with respect to blank 100', although different materials may be used for each of the tray and the base carton.

Figure 5:
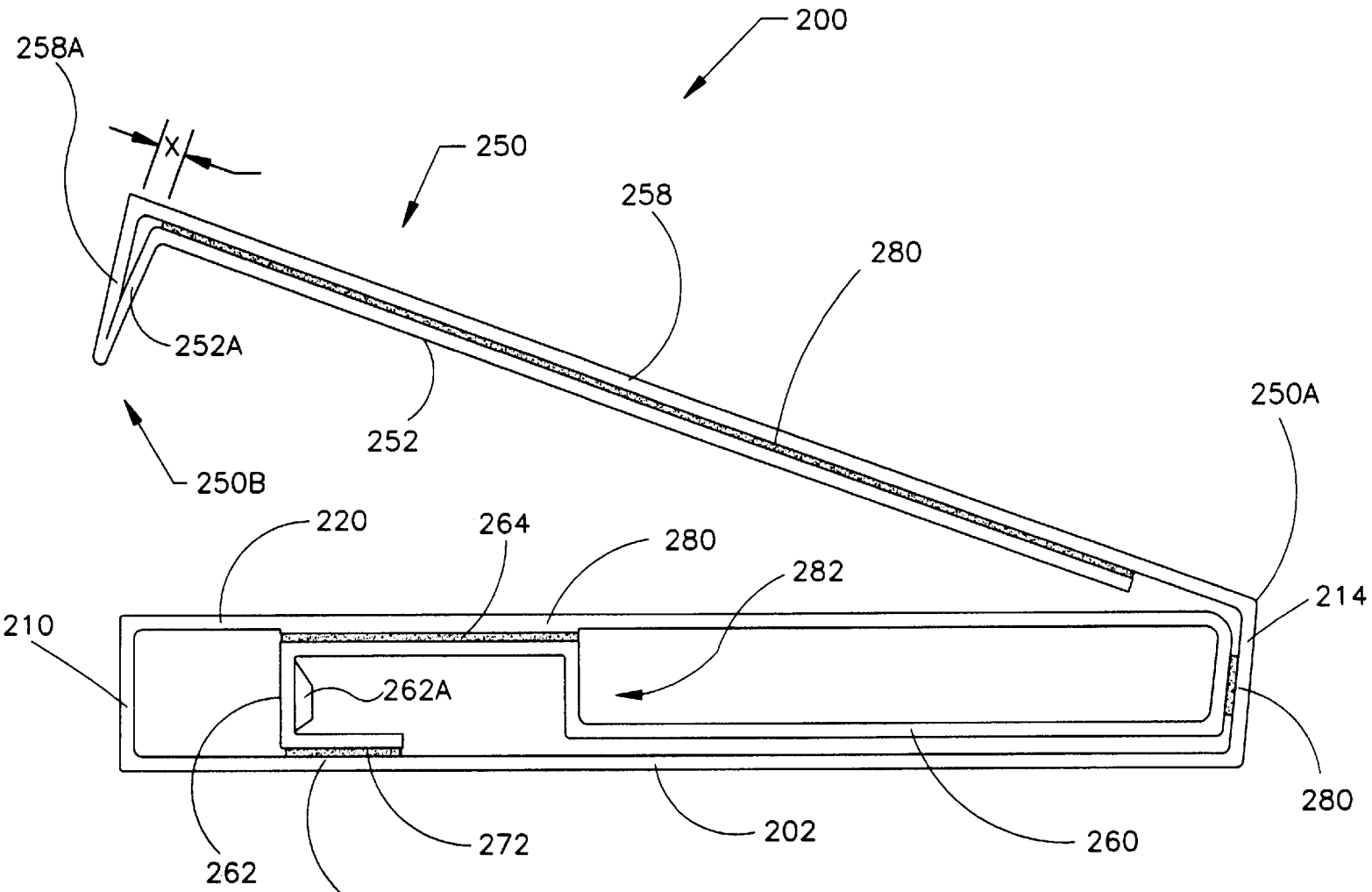
FIG. 5 is a side elevational view of the base carton with the side walls thereof removed, the cover flap being partially open and the tray altogether removed.

The initial steps of constructing base carton 200 and cover flap 250 will be best appreciated from reference to FIGS. 4 and 5. Panels 272, 262, 264, 266, 260, 270, 220, 210, 202, 214, 258, 258A, 252A, and 252 are folded in appropriate fashion to achieve the structure as shown in FIG. 5 (wherein side panels 206, 208 are removed). Suitable adhesive 280 is applied between the respective panels as noted in FIG. 5. The pattern of the adhesive applied between the respective panels will depend on the requirements of the package and the materials chosen. Side panels 206 and 208 are folded inwardly.

Preferably, panel 252A has a width K which is less than the width J of panel 258A. As a result, when the panels are folded as shown in FIG. 5, a gap is created between the fold of panels 252 and 252A and the fold of panels 258 and 258A. Preferably, the difference between the widths J and K is about 1/16 inch, typically resulting in a gap X (see FIG. 5) of about 1/16 inch.

Figure 8:
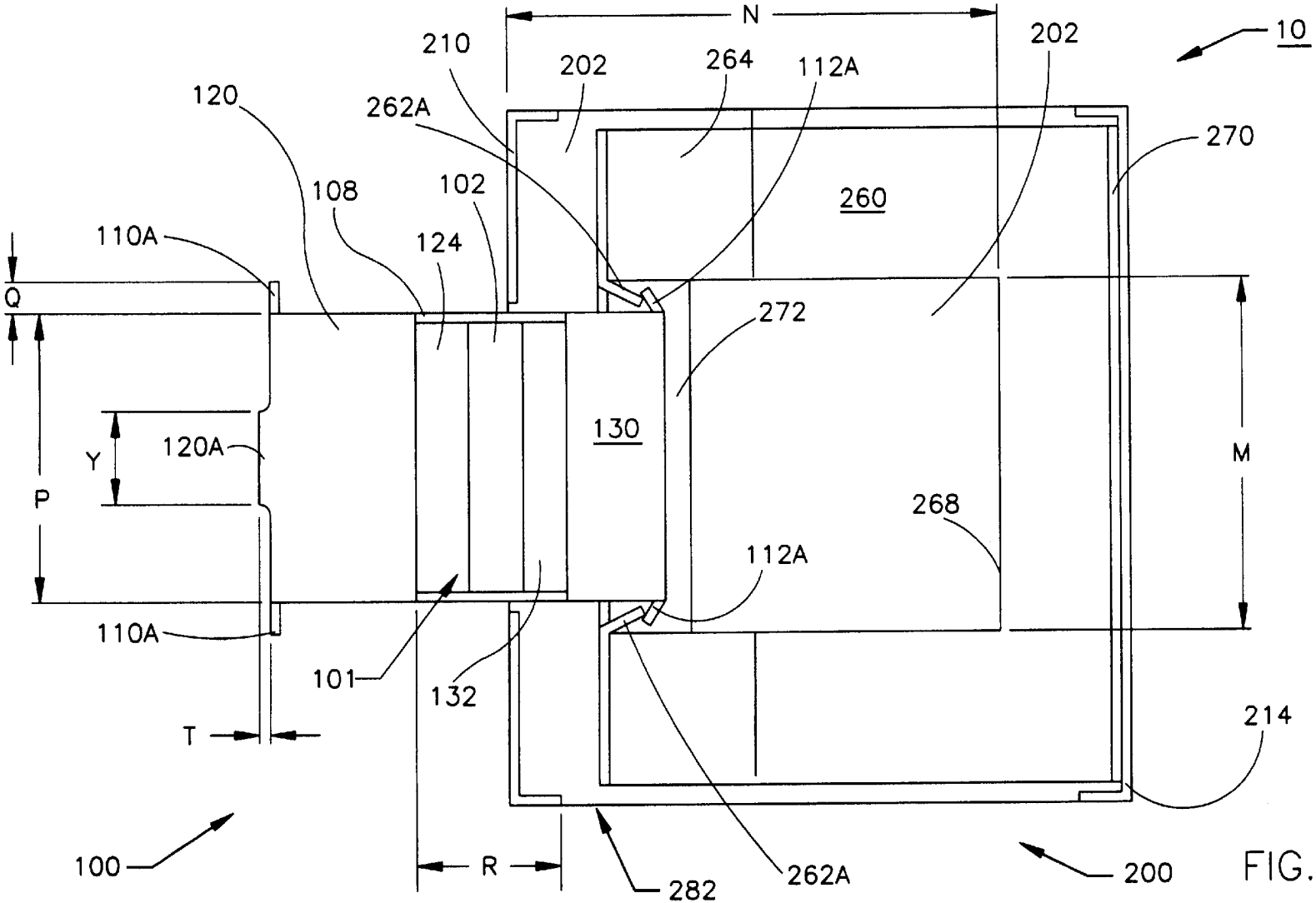
FIG. 8 is a top plan view of the carton with the cover flap and top wall of the base carton removed, the tray being in a fully extended position.

As best seen in FIGS. 1 and 8, base carton 200 is configured to slidably receive and hold carton 100. FIG. 8 shows carton 10 with cover flap 250, top panel 220, and side panels 206, 208 removed for clarity. Front end wall 210 has opening 210A formed therein. Preferably, opening 210A has a width O (see FIG. 4) slightly greater than width P (from side wall 106 to side wall 108; see FIG. 8) of tray 100. Panels 272, 262, 264, 266, and 260 together form a partition 282. Partition 282 defines a cutout or inner periphery 268 having a width M. Width M is also preferably slightly greater than width P of tray 100. It will be appreciated from the foregoing that opening 210A and partition 282 cooperate to maintain alignment of tray 100 throughout its range of movement.

Front side tabs 110A of tray 100 serve to prevent over-insertion of tray 100 into base carton 200. More particularly, tabs 110A extend beyond the periphery of opening 210A and brace against the outer surface of front end wall 210 when tray 100 is fully inserted. Preferably, the depth N of cutout 268 is chosen such that rear end panel 114 of tray 100 braces against the back edge of cutout 268 when tray 100 is fully inserted. Preferably, the width Q of each of tabs 110A is in the range of from about 1/16 inch to about 1/8 inch, and more preferably is about 1/8 inch Complete removal of tray 100 from base carton 100 is resisted or prevented by the interaction of tabs 112A and 262A. After tray 100 and base carton 200 are assembled as described above, tray 100 is inserted through opening 210A into base carton 200. When this occurs, tabs 262A are bent inwardly as shown. Also, tabs 112A are bent outwardly as shown. When the user attempts to withdraw the tray beyond the fully extended position as shown in FIG. 8, tabs 112A interlock with tabs 262A. The coexistence of the tabs as well as their relative assembled geometries prevent, at the very least, accidental removal of tray 100 from base carton 200. Preferably tabs 262A each have a length W (see FIG. 4) of about 3/16 inch. Preferably tabs 112A have a length of from about 1/16 inch to about 3/32 inch.

From the foregoing, it will be appreciated that trays of different widths and lengths may be accommodated simply by appropriately changing the dimensions of opening 210A and cutout 268. Moreover, the placement of the tray with respect to the base carton may be altered as well. That is, the tray need not be positioned in the center of the front panel. The tray could be off center. In general, it is a significant advantage of the present invention that trays of various sizes and configurations may be used without requiring modification of the size and shape of the base carton, and further, while providing the alignment and drawer stop functions described above. As a result, a base carton 100 of a given size may be used for a wide variety of products, providing substantial savings and deficiencies in manufacture, handling, and bulk packaging. Thumb cutouts 220A are preferably formed in top panel 220 and bottom panel 202 adjacent opening 210A to provide convenient access to tray 100 to begin pulling.

With reference to FIGS. 4, 5, 6, and 7, slot 256 of cover flap 250 cooperates with tab 120A of tray 100 to hold cover flap 250 in a closed position as shown in FIG. 6. Cover flap 250 may be opened by pulling upwardly on cover flap 250, or preferably pulling outwardly and upwardly on subflap 250B, causing tab 120A to temporarily upwardly deform. Preferably, tab 120A has a length T (see FIG. 8) of from about 3/64 inch to about 5/64 inch, and a width Y (see FIG. 8) of from about 1 inch to about 2 inches. The width Z (see FIG. 4) of slot 256 is preferably about 1/8 inch greater than width Y. The dissimilar widths J and K of subflap panels 258A and 252A (see FIG. 4) and the resulting gap dimension X (FIG. 5) provide subflap 250B with a spring effect which tends to keep subflap panel 252A in proximity to front panel 210. As a result, tab 120A tends to remain in slot 256.

Figure 3:
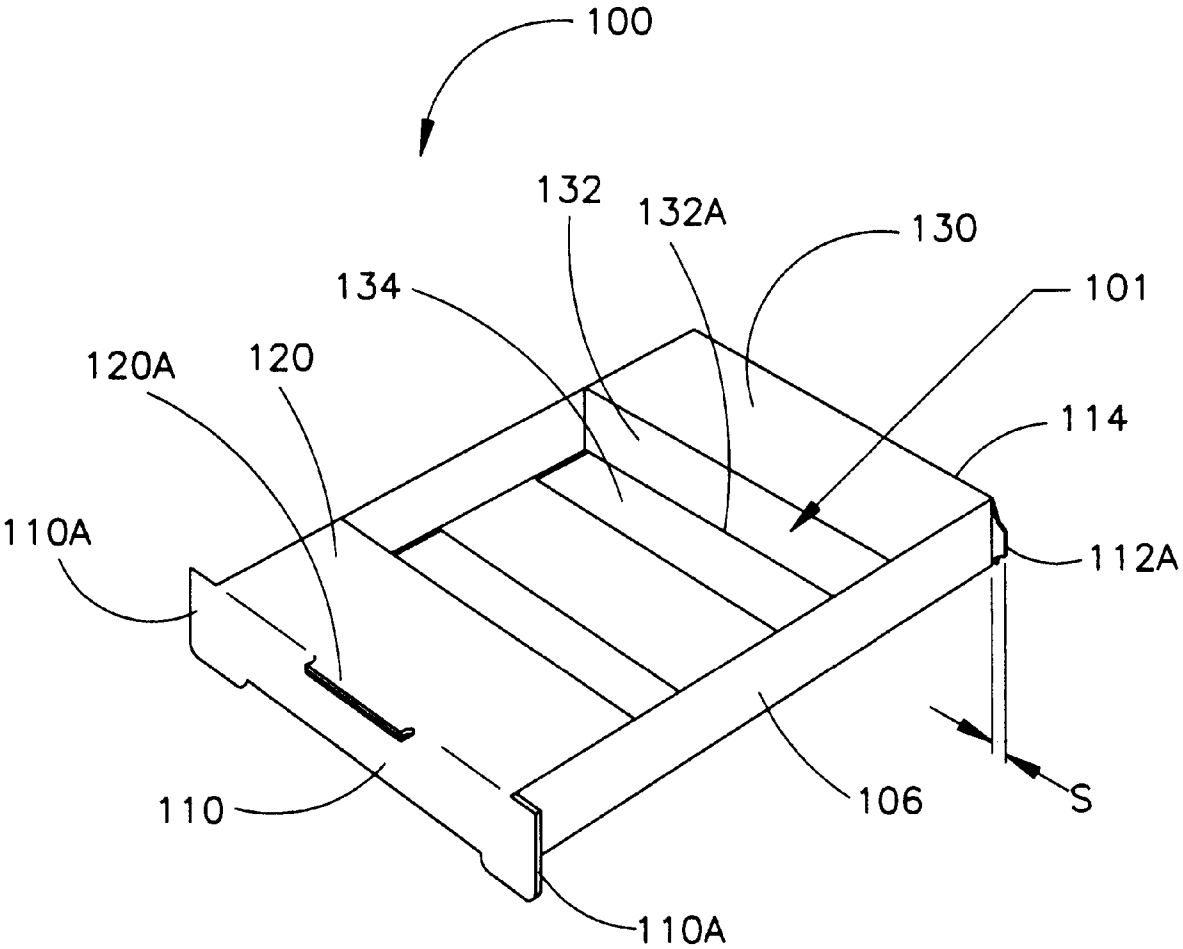
FIG. 3 is a perspective view of the tray.

With reference to FIGS. 2 and 3, tray 100 includes compartment 101 defined between panels 122 and 132 and between side panels 106 and 108. With reference to FIG. 1, top panel 220 of base carton 200 includes opening 222 defined therein. In the embodiment as shown in the figures, preferably the width P and length R (see FIG. 8) of compartment 101 are each less than the corresponding width U and length V of base carton 200 (see FIG. 4). In this case, an article having roughly the same dimensions as compartment 101 may be placed therein and inserted into base carton 200 along with tray 100. The article would then be visible through opening 222 but would not be removable through opening 222 as it would have dimensions greater than the opening. Also, because the side walls and rear end wall (as well as top panel 130) of the tray are covered by portions of top panel 220 beyond opening 222, there is no tendency for tray 100 to pivot downwardly in the front and upwardly in the rear when the tray is partially withdrawn. As an alternative to or in addition to the above configuration, a layer of film, preferably transparent, may extend across opening 222 and be adhered adjacent the periphery thereof. It will be appreciated that, while the relative tray and opening configuration described above provides certain advantages, any suitable tray design may be employed. Further, the opening 222 may be eliminated altogether.

Figure 7:
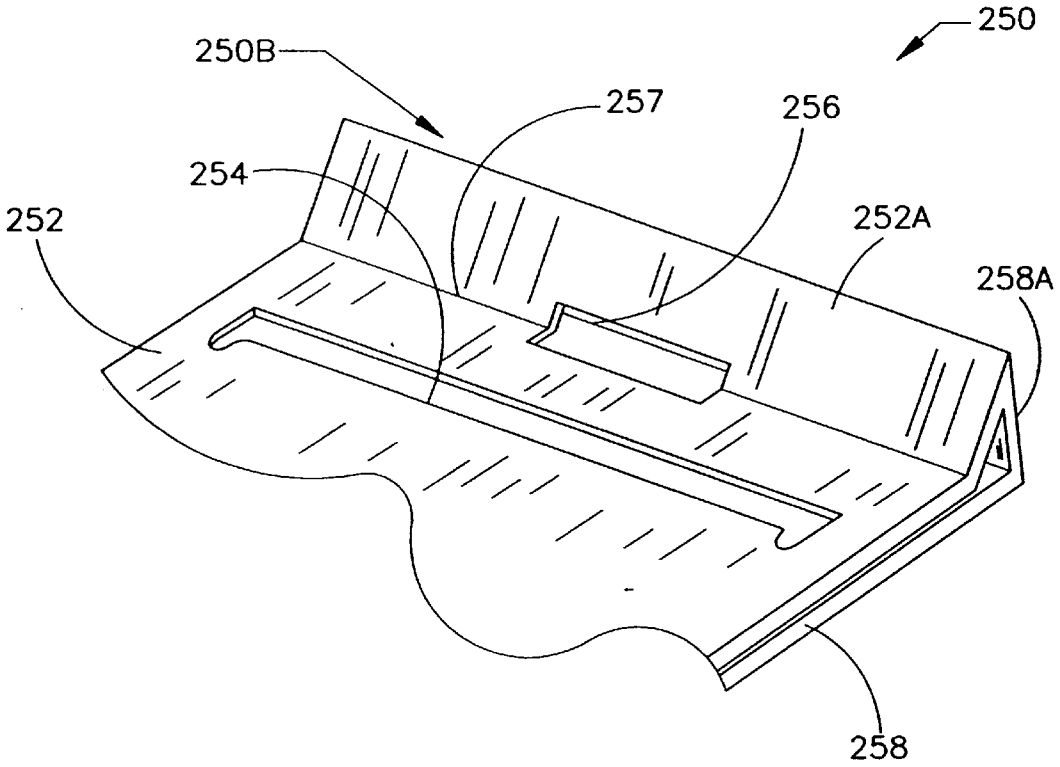
FIG. 7 is a fragmentary, perspective view of the cover flap.

With reference to FIG. 7, cover flap 250 may be provided with a slot 254 formed in panel 252 thereof. Slot 254 may be used to hold additional articles, for example, an informational booklet. Preferably, the glue which holds panels 252 and 258 together is applied only along the respective edges thereof, forming an envelope between the panels which is accessible through slot 254. The back cover of a booklet, for example, may be inserted into this envelope so that the booklet hangs from slot 254 and may be accessed by the user. Additional uses will be appreciated by those of ordinary skill in the art. Further, suitable indicia and graphics may be printed on any of the exposed panels of the base carton, the cover flap, and the tray.

It will be appreciated from the foregoing that the carton of the present invention may be used to package a wide variety of products. For example, pharmaceuticals, tobacco products, and software may be housed in the tray. Further, related informational or promotional literature or other articles may be secured to or printed on the base carton.

While a preferred embodiment of the present invention has been described, it will be appreciated by those of ordinary skill in the art that certain modifications may be made without departing from the scope of the present invention. For example, tabs 112A of the tray may abut the interior surface of front end wall 110, rather than tabs 262A of the partition, to resist removal of the tray from the base carton. Also, subflap 250B and tray 100 need not be disposed adjacent the end panel of base carton 200 opposite fold 250A. Rather, it is contemplated that the subflap and the tray may be positioned at one of side panels 206 and 208, so long as they are both on the same side. Further, the flap may be separately formed from the base carton and secured thereto by suitable means such as adhesive or staples. Such modifications will typically increase the cost and complexity of manufacturing the carton, but may be advantageous for certain applications. All such modifications are intended to come within the scope of the claims which follow.

What is claimed is:

1. A folding carton for holding an article in a slidable tray therein such a way as to be visible to a consumer, comprising:

a) a base carton formed from a foldable material having opposed top and bottom spaced apart panels, and opposed first and second side panels;

b) said top panel having an opening therein through;

c) a tray having an open top compartment therein greater than the opening in the top panel of said carton, said tray slidably mounted between said top and bottom panels and between said side panels and being spaced apart from at least one of said side panels;

d) a partition disposed between said top and bottom panels of said carton and between said tray and one of said side panels, said partition arranged and configured to maintain said tray in a prescribed alignment with respect to said base carton and to maintain said tray in spaced relation with said side panels; and e) whereby an article having dimensions greater than the opening in said top wall, but less than the compartment is retained in said carton, but is visible to a consumer.

2. The carton of claim 1 including a second partition opposite and spaced from said first partition, said second partition disposed between said top and bottom panels and between said tray and said second side edge, said second partition arranged and configured to maintain said tray in said prescribed alignment with respect to said base carton and to maintain said tray in spaced relation with said second side edge.

3. The carton of claim 1 including a stop tab extending from said tray, said stop tab operative to resist removal of said tray from said base carton.

4. The carton of claim 3 wherein said base carton includes a front wall having an opening formed therein, said tray slidable through said opening, and wherein said opening, said tray, and said stop tab are relatively arranged and configured such that said stop tab resists removal of said tray from said base carton by abutting a portion of said front wall adjacent said opening when said tray is in a fully extended position with respect to said base carton.

5. The carton of claim 3 wherein said tray, said stop tab, and said partition are relatively arranged and configured such that said stop tab resists removal of said tray from said base carton by abutting a portion of said partition when said tray is in a fully extended position with respect to said base carton.

6. The carton of claim 5 wherein said base carton includes a front wall having an opening formed therein, said tray slidable through said opening, and wherein said portion of said partition is spaced rearwardly from said front wall.

7. The carton of claim 5 wherein said portion of said partition includes a partition tab biased inwardly from said partition in the path of said stop tab.

8. The carton of claim 1 including a limiter tab extending sidewardly from a front end of said tray, said base carton including a front wall having an opening formed therein, said tray slidable through said opening, wherein said tray, said limiter tab, and said opening are relatively arranged and configured such that said limiter tab resists overinsertion of said tray into said base carton by abutting a portion of said front wall adjacent said opening when a prescribed amount of said tray is inserted into said base carton.

* * * * *